United States Patent [19]

Inovius

[11] 4,262,609

[45] Apr. 21, 1981

[54] INCINERATORS

[76] Inventor: Allan Inovius, Building le Continental, Block A, Monte Carlo, Monaco

[21] Appl. No.: 31,314

[22] Filed: Apr. 19, 1979

[30] Foreign Application Priority Data

Apr. 26, 1978 [SE] Sweden ..... 7804761
Apr. 26, 1978 [SE] Sweden ..... 7804763

[51] Int. Cl.[3] ..... F23G 5/00
[52] U.S. Cl. ..... 110/244; 431/158
[58] Field of Search ..... 110/244, 235, 243, 336, 110/346; 122/4 D; 126/19 R; 431/158

[56] References Cited

U.S. PATENT DOCUMENTS

| | | | |
|---|---|---|---|
| 2,718,460 | 9/1955 | Bowen | 122/4 D |
| 2,778,610 | 1/1957 | Bruegger | 122/4 D |
| 3,848,550 | 11/1974 | Bowen | 110/244 |
| 3,889,608 | 7/1975 | Pitt | 110/244 |
| 4,060,662 | 11/1977 | Bergeron | 126/19 R |
| 4,089,303 | 5/1978 | Brulfert | 122/4 D X |

*Primary Examiner*—Edward G. Favors
*Attorney, Agent, or Firm*—B. P. Fishburne, Jr.

[57] ABSTRACT

An incinerator apparatus consists of a container with an inlet for gaseous or particulate, combustible material together with combustion air, and has an outlet for combustion products, the walls of the container, and possible walls disposed in the interior of the container, being designed for the generation or vortices in the material flowing through the container from the inlet to the outlet. At least the surfaces of the walls facing the inner space of the container include a substance which has the capability to catalyze the oxidation of carbon and carbon compounds in the combustion in the apparatus.

3 Claims, 6 Drawing Figures

INCINERATORS

The present invention relates to an incinerator for the combustion of a mixture of gaseous or particulate, combustible material and combustion air. The incinerator comprises a container with an inlet for gaseous or particulate, combustible material together with combustion air and with an outlet for combustion products.

According to the invention, the incinerator apparatus is characterized in that the walls of the container, and possible walls, disposed within the interior of the container, are designed to generate vortices in the material flowing through the container from the inlet to the outlet, and that at least the surfaces of the walls facing the inner space of the container include, throughout all or part of their extent, a substance having the capability to catalyse the oxidation of carbon and carbon compounds in the combustion in the apparatus.

The apparatus according to the invention makes possible the combustion of the most diverse gaseous or particulate materials which contain carbon or carbon compounds, in such a complete manner that the exhaust combustion gases are practically free of soot, carbon monoxide and hydrocarbon residues. The apparatus has many different fields of application in which the emphasis is placed on heat generation or on the achieval of a practically total combustion of gaseous or particulate combustible material.

The present invention and its aspects will be more readily understood from the following brief description of the accompanying drawings, which show two embodiments of the invention, and discussion relating thereto.

Figure 1:
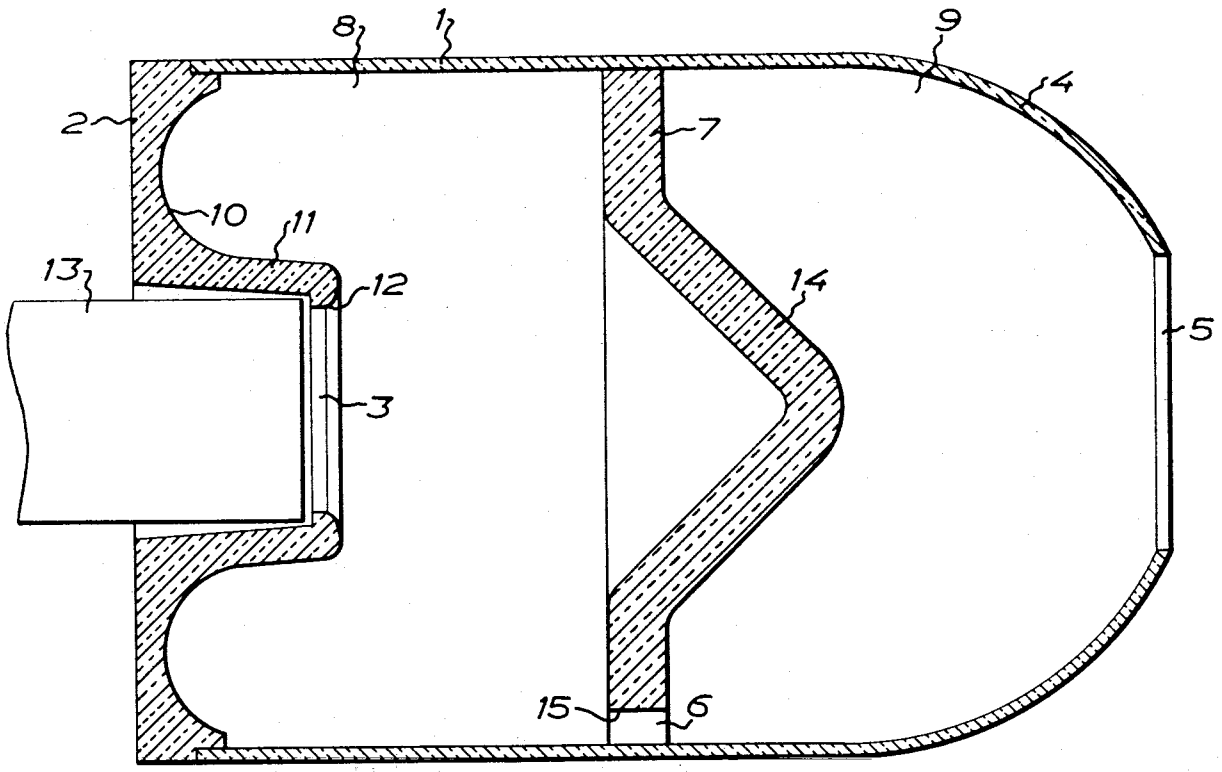
FIG. 1 is a longitudinal section through one embodiment of the incinerator apparatus according to the invention.
Figure 2:
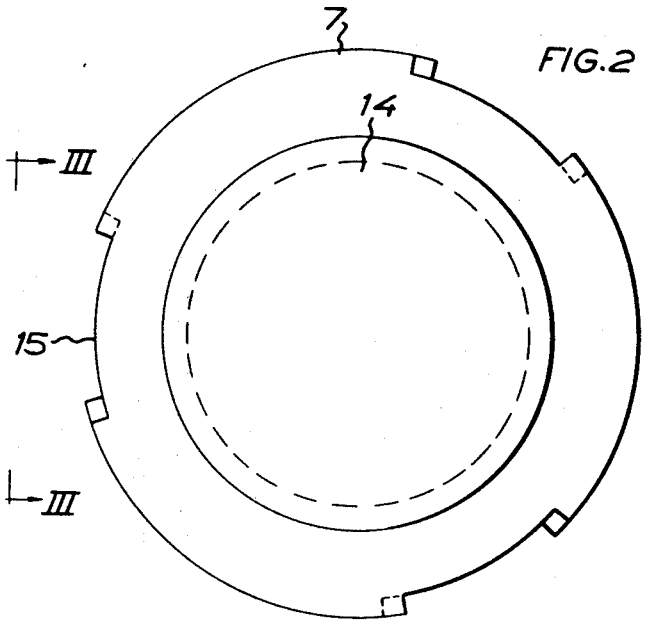
FIG. 2 shows a partition, included in the apparatus, seen from the right in FIG. 1.
Figure 3:
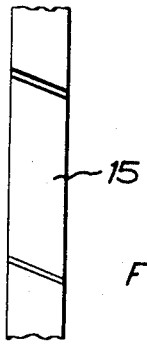
FIG. 3 illustrates an edge portion of the partition, seen from the line III—III in FIG. 2.

The apparatus shown in FIGS. 1-3 has a casing with an approximately cylindrical circumferential wall 1 which, at its ends, is sealed by means of an inlet wall 2 with a central inlet opening 3 for gaseous or particulate combustible material together with combustion air, and an outlet wall 4 with a central outlet opening 5 for combustion products. A partition 7 provided with a through flow 6 is disposed within the casing wall 1 and divides the interior of the casing wall into an inlet chamber 8 and an outlet chamber 9.

The outlet wall 4 is spherically dome-shaped and faces with its concave side towards the outlet chamber 9. Suitably, the outlet wall 4 is manufactured integrally with the casing wall 1.

The inlet wall 2 is designed as a special part which may be fixedly mounted to one end of the casing wall 1 by means of suitable mounting members (not shown in detail) and has an annular depression 10 surrounding the inlet opening 3, the defining surface of the depression being, in cross section, lightly rounded, for example circular-arcuate. The inlet opening 3 is located in the narrow end of a conical sleeve portion 11 whose outer face gently merges into the annular depression 10. The free end of the sleeve portion 11 is provided with an inwardly directed flange 12 which serves as a heat protector for the end of a pipe 13 which is inserted, from the outside into the sleeve portion 11 and serves to aspirate into the apparatus a mixture of combustion air and gaseous or particulate combustible material.

The partition 7 is disc-shaped and a has a central portion 14 which is designed to form a conical casing whose outside is turned to face the outlet chamber 9 and whose inside is turned to face the inlet chamber 8. The partition 7 is designed as a special part which is fixedly mounted within the casing wall 1 by means of anchorage members (not shown) of suitable type. The peripheral edge of the partition 7 is provided with at least three edge recesses 15 evenly distributed around the circumference and extending obliquely through the partition as is most clearly apparent from FIG. 3. These edge recesses define, together with the casing wall 1, the through flow 6 which communicates the inlet chamber 8 with the outlet chamber 9.

In order to achieve as complete combustion as possible in the apparatus, at least some, and preferably all, of the parts of the apparatus: the cylindrical casing wall 1, the inlet and outlet walls 2 and 4 and the partition 7 should, in their entirety or at least on their surfaces facing the interior of the apparatus, contain throughout the whole or part of the extent of the surfaces, a material which has the capability of catalyting the oxidation of carbon and carbon compounds in the combustion in the apparatus. A suitable construction material for one or more of the above-mentioned apparatus parts is an alloy of 20-30% by weight chromium, 4-6% by weight aluminum, 0-3% by weight cobalt, the remainder being iron. In the utilization of such an alloy in the apparatus, a catalytically active alumina layer is formed on the alloy surface. Another possibility is that at least some of the above-mentioned apparatus parts, preferably the cylindrical casing wall 1 and the outlet wall 4, be manufactured from ceramics which will withstand violent temperature changes. Furthermore, it is possible to manufacture at least some of the above-mentioned apparatus parts, preferably the partition 7 and the inlet wall 2, from ceramics containing a dominant content, for example at least 60% by weight, of $Al_2O_3$ fibres.

A suitable field of application to the apparatus shown in FIGS. 1-3 is use as a heat-generating insert in the furnace hearth in an oil-fired boiler for central heating plants, the pipe 13 constituting the nozzle pipe of a normal oil burner assembly. In such an instance, the mixture of oil and combustion air aspirated through the pipe 13 is ignited and blown from the pipe 13 as a flame into the inlet chamber 8 towards the conical portion 14 of the partition 7, whence the burning mixture is deflected towards the annular depression 10 in the inlet wall 2 under the generation of powerful turbulence, whereafter the burning mixture enters, through the through flow 6, into the outlet chamber 9 where the mixture continues to flow turbulently. As a result of the inclination of the edge recesses 15 in the partition 7, the gas mass flowing into the outlet chamber 9 is also set in rotation about the longitudinal axis of the apparatus. Finally, the combustion products depart through the outlet 5 to the furnace hearth compartment of the boiler and eventually to a smokestack. As a result of the described, turbulent flow of the combustible mixture and combustion products, a lenghty and intimate contact is obtained with the catalytically active surfaces of the apparatus in the inlet chamber 8 and outlet chamber 9 so that the combustion will be complete, without soot, carbon monoxide or hydrocarbon compounds in the combustion products departing through the outlet 5.

Instead of being supplied with a combustible oil-air mixture from an oil burner assembly, the apparatus may also be supplied, through the pipe 13, with a mixture of carbon powder and air, when, for example, the apparatus is being used as an insert in the furnace hearth compartment of a boiler. Furthermore, it is possible to utilize the apparatus for the final combustion of yet combustible products containing exhaust flues from a furnace, the exhaust flues being introduced into the apparatus through the inlet sleeve 13, possibly together with an extra addition of combustion air. Since the apparatus is disposed with its longitudinal axis vertical and with the inlet wall 2 lowermost, it may be advisable to provide openings in the inlet wall which extend through the inlet wall from the bottom of the annular depression 10 to the underside of the inlet wall where the openings are sealed by means of removable lids. Any possible incombustible ash formed in the combustion in the apparatus will, in this instance, impinge upon the casing wall 1 during the turbulent flow between the inlet wall 2 and the partition 7 and will move downwardly along the casing wall to the depression 10 in order finally to be collected in the above-mentioned openings in the inlet wall, whence the ash may be withdrawn by removing the lids.

Figure 4:
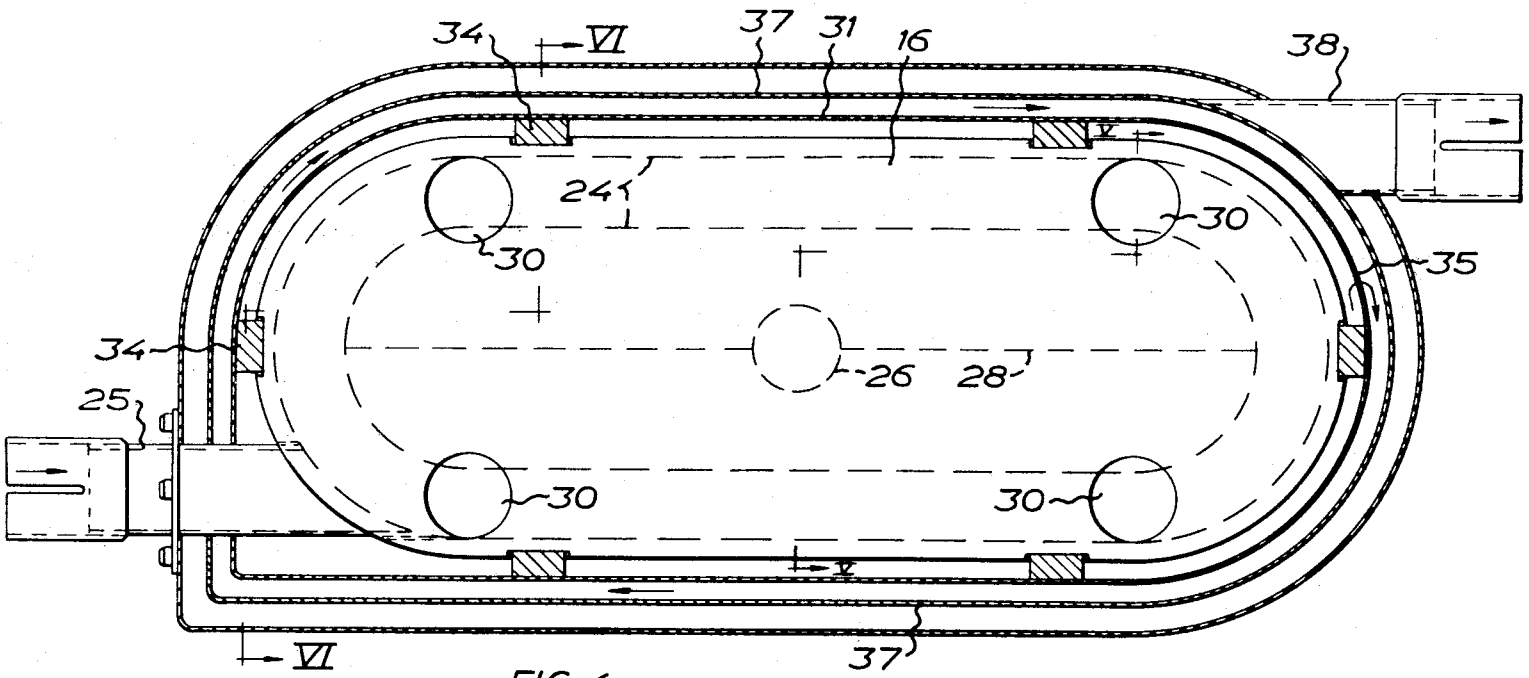
FIG. 4 shows a second embodiment of the apparatus according to the invention, partly in projection and partly in section along the line IV—IV in FIG. 6.
Figure 5:
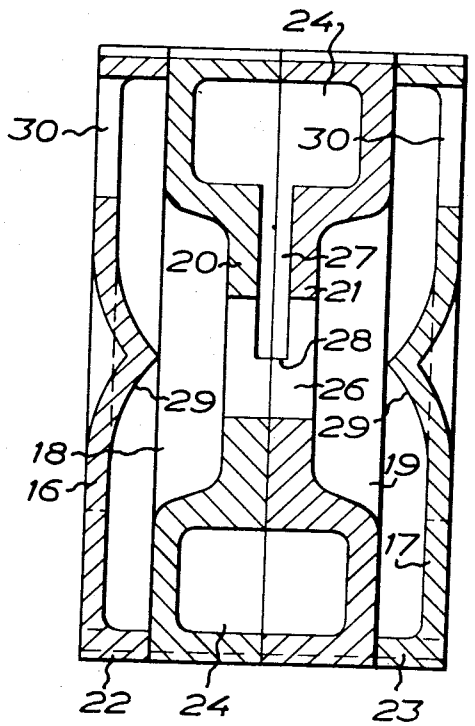
FIG. 5 shows a section along the broken line V—V in FIG. 4.
Figure 6:
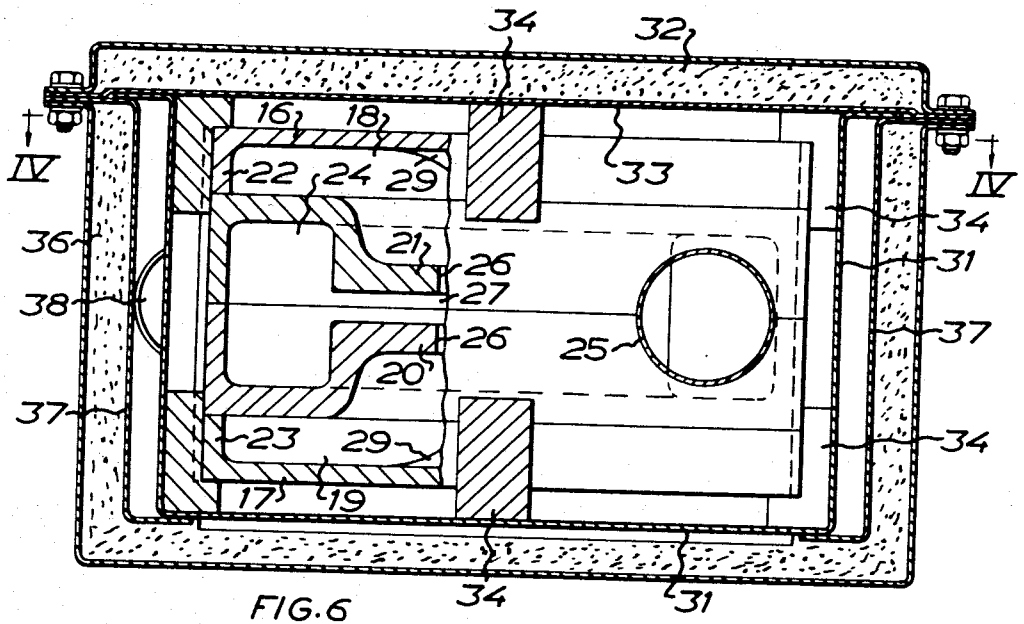
FIG. 6 is a section along the broken line VI—VI in FIG. 4.

The apparatus illustrated in FIGS. 4–6 has a box with two end walls 16 and 17 and a partition which divides the space between the end walls into two chambers 18 and 19 and which consists of two parts 20 and 21. The end walls 16 and 17 are substantially planar and elongate with rounded-off ends, as is apparent from FIG. 4. The end walls 16 and 17 each have a circumferential edge flange 22 and 23, respectively, which, together with the circumferential portions of the partition parts 20 and 21, form the side walls of the box.

One or more, and preferably all, of the walls of the box are in their entirety, or at least on their surfaces facing the interior of the box, manufactured, throughout all or part of the extent of the surfaces, from a material which contains a substance catalysing the oxidation of carbon monoxide and hydrocarbon compounds. Examples of suitable such materials have been given above in conjunction with the description of the embodiment according to FIGS. 1–3.

The partition formed of the parts 20 and 21 contains an annular channel 24 which extends slightly inside the side walls of the box. An inlet 25 for hot combustion gases, for example from an internal combustion engine or a furnace, is connected to this channel 24. The partition formed of the parts 20 and 21 has a central opening 26 which communicates the two chambers 18 and 19 with each other and which, by means of slots (one or more slots) 27 in the partition, is in communication with the annular channel 24. The slot 27 may extend all the way round the opening 26 and the channel 24, but is shown in the embodiment according to FIGS. 4–6 as extending throughout but half (the upper half in FIG. 4) of the outer circumference of the opening 26 and the inner circumference of the channel 24, as intimated by means of the end limit 28 of the slot in FIGS. 4 and 5. The end walls 16 and 17 are provided, opposite the central opening 26 of the partition, each with a conical projection 29 directed towards the central opening. A distance from the central opening 26 of the partition, the chambers 18 and 19 are provided with outlets for the combustion gases in the form of four holes 30 in each end wall 16, 17.

The box formed by the parts 16, 17, 20 and 21 is surrounded, with play, by a casing in the form of a shell 31 and a lid 33 provided with thermal insulation 32. The box is kept spaced from the walls of the casing 31, 33 by means of a number of spacers 34. The outlets 30 of the chambers 18, 19 discharge into the casing 31, 33, which is provided with an outlet 35 for the combustion gases. The casing shell 31 is surrounded, with play, by a jacket 37 provided with thermal insulation 36, in which jacket the outlet 35 of the casing discharges, and which has an outlet 38 for the combustion gases.

When the apparatus according to FIGS. 4–6 is utilized, hot combustion gases containing carbon monoxide and hydrocarbon compounds are supplied through the inlet 25 to the annular channel 24 where the gases will flow at high velocity in a circuitous path and will gradually flow further through the slot 27 to the central opening in the partition 20, 21. In the opening 26, the gases deviate in both directions to the chambers 18 and 19 there they impinge upon the conical projections 29 on the end walls 16, 17, the projections distributing the gases in the chambers 18, 19. Finally, the gases depart from the chambers 18, 19 through the outlets 30 to the space between the box 16, 17, 20, 21 and the casing 31, 33, where the gases flow round the box to the outlet 35 of the casing in order thereafter to flow into the space between the shell 31 and the jacket 37 in order finally to depart through the outlet 38. During this flow within the box 16, 17, 20, 21 and therearound, the gases will come into intimate and lengthy contact with the box material heated by the gases to high temperature, the material in this instance acting catalytically for the oxidation of carbon monoxide and hydrocarbon compounds in the gases, so that the combustion products departing through the outlet 38 are practically completely free of carbon monoxide and hydrocarbon compounds.

What I claim and desire to secure by Letters Patent is:

1. Incinerator apparatus comprising a casing including a substantially cylindrical mantle, an inlet wall sealing one end of said mantle and the defining a central inlet opening for gaseous or particulate, combustible material together with combustion air, an outlet wall sealing the other end of said mantle and defining a central outlet opening for combustion products, and a partition wall within said casing dividing the interior of said casing into an inlet chamber adjacent said inlet wall and an outlet chamber adjacent said outlet wall, said inlet wall having, on its side facing the inlet chamber, an annular depression surrounding the inlet opening, the defining surface of the depression being smoothly rounded in cross-section, said outlet wall being dome-shaped with the concave side facing the outlet chamber, the central portion of said partition wall being formed as a conical mantle whose outside faces the outlet chamber and whose inside faces the inlet chamber, and said partition wall having at least three edge recesses distributed around the periphery of said partition wall and defining together with said cylindrical mantle communication passages between the inlet and outlet chambers.

2. Apparatus according to claim 1, wherein said edge recesses of said partition wall extend obliquely through said partition wall.

3. Apparatus according to claim 1, wherein at least one of said mantle, said inlet wall, said outlet wall, and said partition wall contains a material having the capability to catalyze the oxidation of carbon and carbon compounds in the combustion in the apparatus.

* * * * *